US009988899B2

(12) United States Patent
Feng et al.

(10) Patent No.: US 9,988,899 B2
(45) Date of Patent: Jun. 5, 2018

(54) ROCK FORMATION TESTING METHOD AND FORMATION TESTING INSTRUMENT

(71) Applicants: China National Offshore Oil Corporation, Beijing (CN); China Oilfield Services Limited, Sanhe (CN)

(72) Inventors: Yongren Feng, Beijing (CN); Minggao Zhou, Beijing (CN); Yanmin Zhou, Beijing (CN); Tao Lu, Beijing (CN); Qiang Yu, Beijing (CN)

(73) Assignees: China National Offshore Oil Corporation, Beijing (CN); China Oilfield Services Limited, Beijing (CN)

( * ) Notice: Subject to any disclaimer, the term of this patent is extended or adjusted under 35 U.S.C. 154(b) by 234 days.

(21) Appl. No.: 14/771,210

(22) PCT Filed: Dec. 25, 2013

(86) PCT No.: PCT/CN2013/090480
§ 371 (c)(1),
(2) Date: Aug. 28, 2015

(87) PCT Pub. No.: WO2014/201836
PCT Pub. Date: Dec. 24, 2014

(65) Prior Publication Data

US 2016/0108727 A1 Apr. 21, 2016

(30) Foreign Application Priority Data

Jun. 18, 2013 (CN) ..... 2013 1 0241437

(51) Int. Cl.
*E21B 49/00* (2006.01)
*E21B 49/10* (2006.01)

(52) U.S. Cl.
CPC ..... *E21B 49/008* (2013.01); *E21B 49/00* (2013.01); *E21B 49/10* (2013.01)

(58) Field of Classification Search
CPC ..... E21B 49/00; E21B 49/10; E21B 49/08; E21B 49/081; E21B 49/087; E21B 49/008; E21B 49/083; E21B 47/106
See application file for complete search history.

(56) References Cited

U.S. PATENT DOCUMENTS 2,747,401 A 5/1956 Doll
3,611,799 A 10/1971 Davis
(Continued)

FOREIGN PATENT DOCUMENTS

CN 1667243 A 9/2005
CN 101575971 A 11/2009
(Continued)

OTHER PUBLICATIONS

Zhou, Minggao et al. "Research on Formation Characteristic Tool and Its Application" Well Logging Technology, Feb. 2008, vol. 32, No. 1, see pp. 72-75.
(Continued)

*Primary Examiner* — Yong-Suk Ro
(74) *Attorney, Agent, or Firm* — Ling Wu; Stephen Yang; Ling and Yang Intellectual Property

(57) ABSTRACT

A method of formation testing and a formation testing instrument are provided. The formation testing instrument includes a first pump, a dual packer module, a reverse injection module and a second pump. The dual packer module is provided with a support arm at one side thereof capable of setting after deployed; and the dual packer module is provided with first and second probes at the other side. The first probe is located above the second probe and the first and second probes can establish a channel with the formation. The second pump injects the acidizing liquid in the reverse injection module into the fluid region in the
(Continued)

formation by the second probe; and the first pump sucks the fluid in the formation by the first probe.

5 Claims, 2 Drawing Sheets

(56) References Cited

U.S. PATENT DOCUMENTS

| | | | | |
|---|---|---|---|---|
| 4,936,139 | A * | 6/1990 | Zimmerman | E21B 49/08 175/40 |
| 5,644,076 | A | 7/1997 | Proett et al. | |
| 5,672,819 | A | 9/1997 | Chin et al. | |
| 7,059,179 | B2 | 6/2006 | Proett et al. | |
| 2006/0046297 | A1 | 3/2006 | Ball | |
| 2008/0066536 | A1 | 3/2008 | Goodwin et al. | |
| 2011/0139448 | A1* | 6/2011 | Ciglenec | E21B 49/081 166/264 |

FOREIGN PATENT DOCUMENTS

| | | | |
|---|---|---|---|
| CN | 103277093 | A | 9/2013 |
| FR | 2798698 | A1 | 3/2001 |

OTHER PUBLICATIONS

Yu, Qiang et al. "Enhanced Reservoir Characteristic Tester and Its Application in Bohai Oilfield", Petroleum Instruments, Dec. 2011, vol. 25, No. 6, see pp. 23-25.

* cited by examiner

ROCK FORMATION TESTING METHOD AND FORMATION TESTING INSTRUMENT

TECHNICAL FIELD

The present invention relates to the field of petroleum exploration technology, in particular, to a method of formation testing and a formation testing instrument.

BACKGROUND OF THE RELATED ART

The vertical permeability of formation is a very important physical parameter in the field of petroleum exploration and development, and a formation tester is often used to obtain the parameter.

At present, a representative formation tester MDT (Modular Formation Dynamics Tester) usually uses a three-probe combination module and related equipment thereof to obtain the vertical permeability of formation. As shown in FIG. 1, after the instrument is lowered into the target layer, the three probes are deployed to complete setting, and a channel is set up between the formation and the instrument. The testing process is as follows: shutting 3# probe, opening 1# and 2# probes, using a pump to extract formation fluid by 1# probe, detecting the change of pressure at the 2# probe, and establishing the relationship between the change of pressure and the distance between 1# and 2# probes as well as the suction amount, thereby obtaining the vertical permeability of formation. The premise of this testing method is that the fluid must satisfy spherical percolation theory. However, the downhole fluid is more often columnar flow and due to various interference factors, the precision of vertical permeability of formation obtained by this manner is limited, even is not in an order of magnitude. In the formation testing instrument, in order to obtain the vertical permeability of formation and the premise of use thereof is that the fluid must satisfy spherical percolation theory. However, due to various interference factors of this testing method, the precision of vertical permeability is limited.

In addition, for some complex formation such as low porosity and low permeability, the conventional method of obtaining fluid sample of complex formation such as low permeability by using formation tester is using a dual packer module and the two rubber sleeves thereof. After the instrument reaches the target layer, the two rubber sleeves of the dual packer are deployed by hydraulic pressure so as to set a section of formation, then using pump to suck and sample. Conventional probe uses Packer rubber to set one point, while the dual packer sets a segment of space and thus the suction area thereof is large so as to avoid influence of low permeability. But the main drawbacks of this method are as follows: the amount of contaminated fluid is large due to the large setting range; in order to obtain the real formation fluid, it usually needs quite a long time (from a dozen hours to dozens of hours, sometimes even up to half a month) to exclude the contaminated fluid, which greatly increases the operation cost (the offshore operation costs around 1 million RMB per day); meanwhile, the instrument being placed under the downhole for long time will greatly increase the cost and risk of downhole operation. Therefore, there are problems such as many interference factors as well as low testing precision, etc, in the existing formation testing instrument technology.

CONTENT OF THE INVENTION

The present invention provides a formation testing instrument, comprising:

a first pump;

a dual packer module, the dual packer module is provided with a support arm at one side thereof capable of setting after deployed, and the dual packer module is provided with a first probe and a second probe at the other side, wherein the first probe is located above the second probe and the first and second probes can establish a channel with the formation;

a reverse injection module; and a second pump, wherein the second pump can inject the acidizing liquid in the reverse injection module into the fluid region in the formation by the second probe; the first pump can suck the fluid in the formation by the first probe.

The first probe and the second probe can be spaced apart.

The formation testing instrument can further comprise a detection control module which is provided to detect the flow of acidizing liquid flowed into the first probe and the flow of the acidizing liquid injected into the second probe.

The detection control module can be provided to obtain the vertical permeability of formation according to the detected flow of the acidizing liquid flowed into the first probe and the flow of the acidizing liquid injected into the second probe.

The present invention further provides a method of formation testing, comprising:

setting after the support arm of the aforesaid formation testing instrument is deployed, and establishing a channel between the first and second probes and the formation;

using the second pump to inject the acidizing liquid in the reverse injection module into the fluid region in the formation by the second probe;

using the first pump to suck the fluid in the formation by the first probe;

detecting the flow of the acidizing liquid flowed into the first probe and the flow of the acidizing liquid injected into the second probe, respectively;

obtaining the vertical permeability of formation based on the detected flow of the acidizing liquid flowed into the first probe and the flow of the acidizing liquid injected into the second probe.

In the above mentioned schemes of the present invention, the combination of dual probes and the reverse injection module is used: to inject the acid liquid into one probe by the reverse injection module, to use the pump to suck the fluid by another probe, to establish communication between the two probes; and to obtain the vertical permeability by detecting the relationship of the flow between the two probes. At the same time, the physical property of formation also can be locally improved by injecting the acid liquid into the formation.

Compared with the related art, when using the above scheme, the instrument, on the one hand, has simple structure and it is convenient and efficient to obtain the vertical permeability of formation; on the other hand, the operation time (shortened from dozens of hours to 2-3 hours) of the complex formation is largely shortened, saving cost and reducing risk.

The other features and advantages of the present invention will be illustrated in the subsequent description, and become partially obvious from the description, or be understood by implementing the present invention. The object and other advantages of the present invention can be implemented and obtained from the description, the claims and the structures specifically pointed out in the drawings.

BRIEF DESCRIPTION OF DRAWINGS

The drawings are provided to further understand the technical scheme of the present invention and constitute a part of the description together with the embodiments of the present invention to explain the technical scheme of the present invention, which are not used to limit the technical scheme of the present invention.

PREFERRED EMBODIMENTS OF THE INVENTION

The embodiments of the present invention will be described in detail below in conjunction with accompanying drawings. It should be illustrated that the embodiments in the present application and the features in the embodiments can be combined with each other randomly without conflict.

Figure 1:
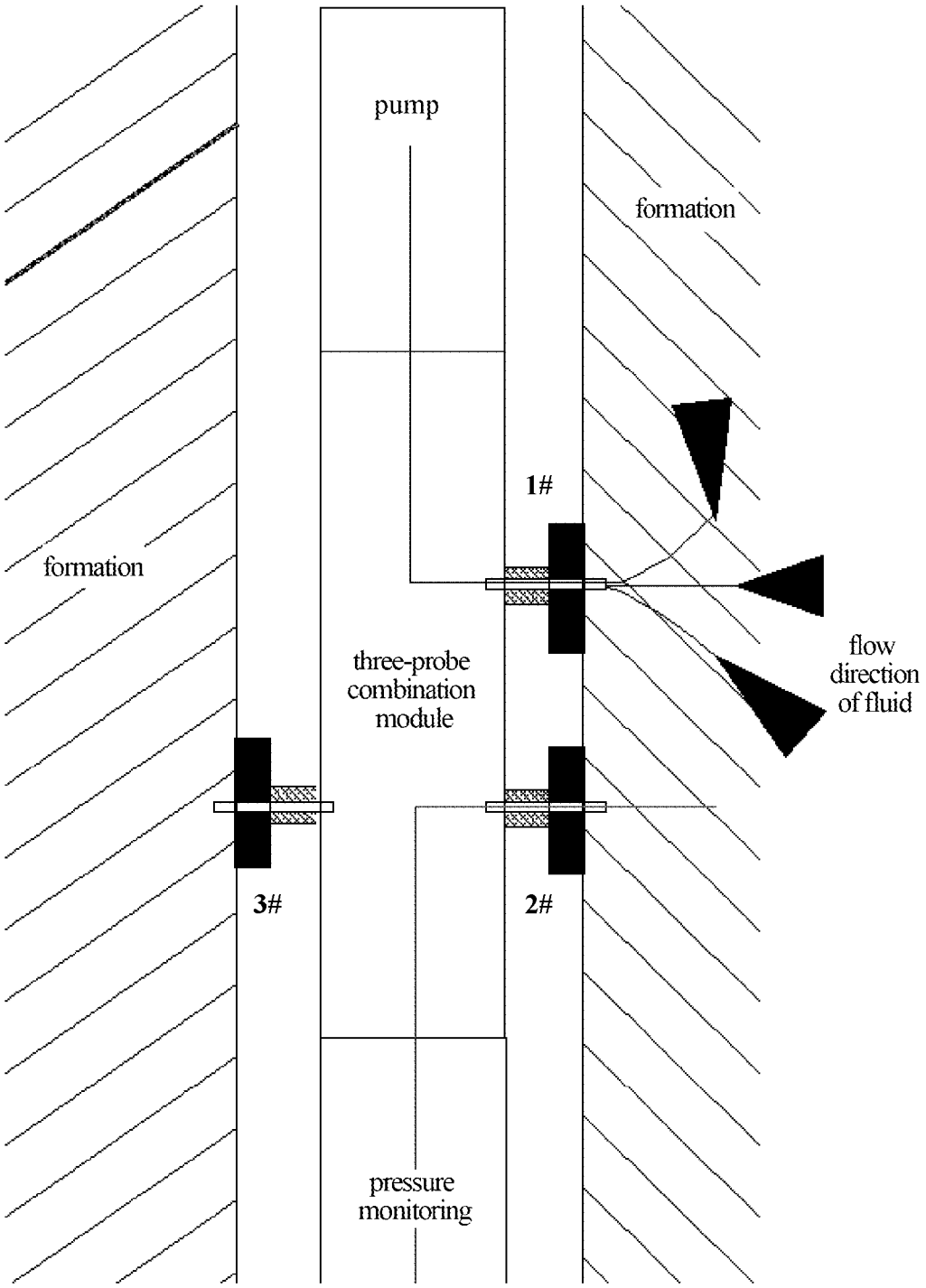
FIG. 1 is a diagram of the existing formation tester.
Figure 2:
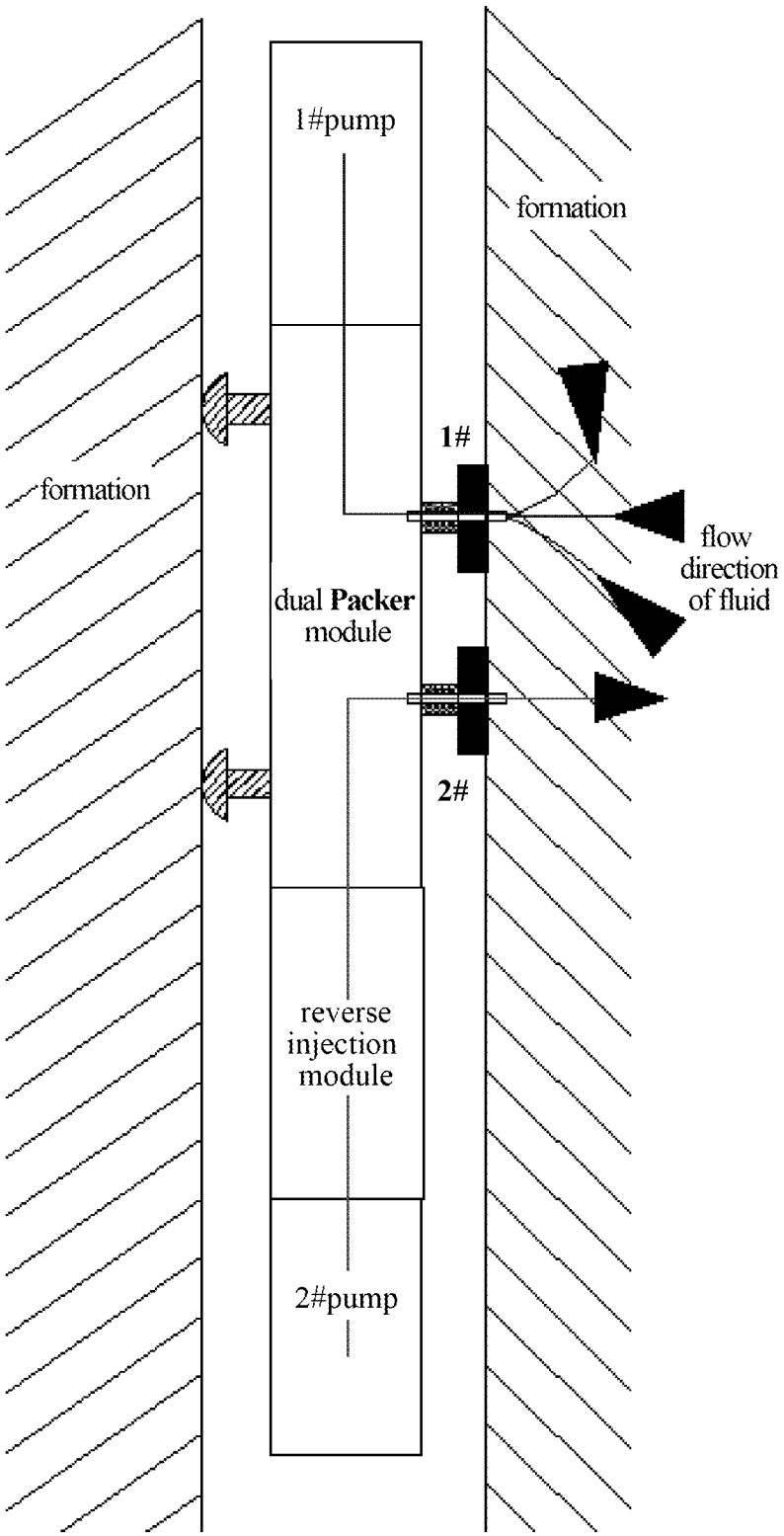
FIG. 2 is a diagram of makeup of the formation testing instrument for obtaining vertical permeability of formation according to the embodiments of the present invention.

The formation testing instrument for obtaining vertical permeability of formation according to the embodiments of the present invention is shown in FIG. 2. As shown in FIG. 2, the formation testing instrument of the present embodiment mainly comprises: a first pump (1# pump), a dual packer module (dual Packer module), a reverse injection module and a second pump (2# pump) provided in sequence from top to bottom.

The dual Packer module is provided with a support arm at one side thereof, and is provided with a first probe (1#) in the upper and a second probe (2#) in the lower at the other side. Preferably, a certain distance is maintained between the two probes so as to avoid the signal being too weak due to too long distance and much interference due to too short distance.

There are acidizing liquid in the reverse injection module, and the second pump injects the acidizing liquid in the reverse injection module into the formation by the second probe.

The first pump sucks the fluid in the formation by the first probe.

In addition, the formation testing instrument for obtaining vertical permeability of formation according to the embodiment further comprises a detection control module, by which the detection and data processing of the flow of the acidizing liquid are performed, and specifically comprising: detecting the flow of the acidizing liquid flowed into the first probe and the flow of the acidizing liquid injected into the second probe; and obtaining the vertical permeability of formation according to the detected flow of the acidizing liquid flowed into the first probe and the flow of the acidizing liquid injected into the second probe.

Referring to FIG. 2, the operation of the formation testing instrument for obtaining vertical permeability of formation according to the embodiment is as follows: after the instrument is lowered into the target layer, the dual Packer module starts working, deploying the probes and the support arm of the dual Packer module for setting, and establishing a channel between the probes and the formation. Injecting the acidizing liquid in the reverse injection module into the formation along the 2# probe (the lower probe) by 2# pump, using 1# pump to suck by 1# probe (the upper probe), detecting the flow of the acidizing liquid flowed into the 1# probe, establishing the functional relationship between the flow of the acidizing liquid injected into 2# probe and the flow of the acidizing liquid sucked in 1# probe, thereby obtaining the vertical permeability of formation.

To sum up, in the above schemes, the precision is higher due to directly establishing the flow relationship between discharging and sucking without the influence of flow regime, etc; meanwhile, the formation can be locally acidized and the physical property thereof (mainly permeability) is improved by injecting and sucking acid liquid so as to achieve the object of measuring pressure and sampling the formation by the dual Packer. Therefore, the operation time for complex formation is greatly shortened from dozens of hours (even more hours) to 2-3 hours.

Although the embodiments disclosed in the present invention are as the above, the described contents are only the embodiments used for the ease of understanding of the present invention, instead of limiting the present invention. Anyone skilled in the art, under the premise of without deviating from the spirit and scope of the disclosure of the present invention, may make various changes and variations in the form and details of implementation. The patent protection scope of the present invention should still be based on the scope defined by the appended claims.

INDUSTRIAL APPLICABILITY

It is convenient and efficient to obtain the vertical permeability of formation by using dual packer to measure pressure and sample the formation according to the embodiment of the present invention, and the operation time for complex formation is greatly shortened, saving cost and reducing risk.

What we claim is:

1. A formation testing instrument, comprising:

a first pump, a dual packer module provided with a support arm at one side thereof capable of setting after deployed and first and second probes on an opposite side, wherein the first probe is located above the second probe and the first and second probes can establish a channel with a formation, a reverse injection module, a second pump, and a detection control module, wherein the second pump can inject an acidizing liquid in the reverse injection module into a fluid region of the formation by the second probe; and the first pump can suck a fluid in the formation by the first probe;

wherein the detection control module is provided to detect a flow of the acidizing liquid flowed into the first probe and a flow of the acidizing liquid injected into the second probe.

2. The formation testing instrument according to claim 1, wherein, the first probe and the second probe are spaced apart.

3. The formation testing instrument according to claim 2, wherein, the detection control module is provided to obtain vertical permeability of formation according to the detected flow of acidizing liquid flowed into the first probe and the flow of the acidizing liquid injected into the second probe.

4. The formation testing instrument according to claim 1, wherein, the detection control module is provided to obtain vertical permeability of formation according to the detected flow of acidizing liquid flowed into the first probe and the flow of the acidizing liquid injected into the second probe.

5. A method of formation testing, comprising:

setting after the support arm of the formation testing instrument according to claim 1 is deployed, and establishing a channel between the first and second probes and the formation;

using the second pump to inject the acidizing liquid in the reverse injection module into the fluid region of the formation by the second probe;

using the first pump to suck the fluid in the formation by the first probe;

detecting the flow of the acidizing liquid flowed into the first probe and the flow of the acidizing liquid injected into the second probe, respectively;

obtaining vertical permeability of formation based on the detected flow of the acidizing liquid flowed into the first probe and the flow of the acidizing liquid injected into the second probe.

* * * * *